United States Patent [19]

Noren

[11] 4,369,806

[45] Jan. 25, 1983

[54] VACUUM BREAKER AND MIXING CHAMBER

[76] Inventor: Tore H. Noren, 3200 Lakeville Hwy., Petaluma, Calif. 94952

[21] Appl. No.: 244,603

[22] Filed: Mar. 17, 1981

[51] Int. Cl.[3] ..... F16K 24/00

[52] U.S. Cl. ..... 137/216; 134/100; 137/897

[58] Field of Search ..... 134/100, 101, 186; 137/216, 896, 897

[56] References Cited

FOREIGN PATENT DOCUMENTS 1166040 10/1969 United Kingdom ..... 137/216

*Primary Examiner*—Gerald A. Michalsky

*Attorney, Agent, or Firm*—Alvin E. Hendricson

[57] ABSTRACT

A mixing chamber has a water inlet and chemical inlet with a depending discharge merging into a duct having an air vent separated from the chamber by an inclined chamber floor.

4 Claims, 5 Drawing Figures

VACUUM BREAKER AND MIXING CHAMBER

BACKGROUND OF INVENTION

Appliances or systems which are adapted to be connected to fresh water pipes are normally provided with means to prevent reverse flow of water into the water pipes. Commercial dishwashers, for example, are required to include a vacuum breaker in the water inlet line so that water cannot be siphoned from the washer into a fresh water system. Although various types of vacuum breakers are possible, it is common to employ a vertical fitting with an opening in a side thereof through which air may pass. Unfortunately, water can and does splash through such an opening so that an operator is at least tempted to block the opening and thus defeat the protection required.

Considering further the field of commercial dishwashers it is noted that various chemicals, at least including a detergent, are inserted in wash water thereof in some automatic manner. Commonly, one or more holes are drilled in the wash chamber and the detergent and other chemicals inserted therethrough so as to fall into the wash tank for mixing with the wash water. This may not insure an even dispersal of a correct concentration of chemicals in the water at all times. While it is known to meter chemicals into the inflowing water for washing or rinsing, it is necessary to employ a vacuum breaker in the water line ahead of the addition.

The present invention provides a combined mixing chamber for mixing metered amounts of chemicals into incoming water and a vacuum breaker or air gap preventing water splashing or leakage from the system.

SUMMARY OF THE INVENTION

The present invention is comprised of a housing defining a chamber having a water inlet in the front face thereof and inlets for chemicals in a side of the chamber. Beneath the water inlet a chamber floor is inclined inwardly and downwardly to an inner vertical wall defining with back and side chamber walls a vertical discharge. A duct depends from the chamber discharge and this duct has a thickness substantially equal to that of the chamber to thus mate with front and back walls of the chamber housing so that the inner vertical wall divides the duct at the top. An air gap is thus defined atop the duct between the front face of the housing and the inner vertical wall beneath the inclined chamber floor and an opening through the front face of the housing immediately beneath the inclined chamber floor vents this air gap or passage to the atmosphere.

BRIEF DESCRIPTION OF FIGURES

The present invention is illustrated as to a single preferred embodiment thereof in the accompanying drawings wherein.

DESCRIPTION OF PREFERRED EMBODIMENT

Figure 1:
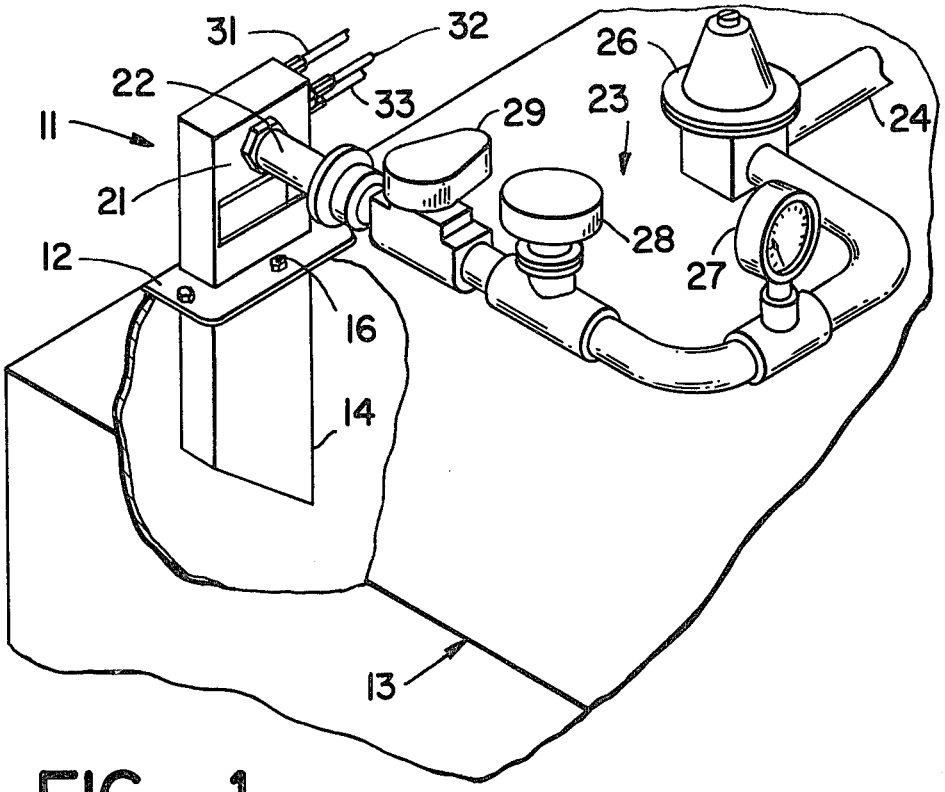
FIG. 1 a schematic perspective illustration of the present invention installed on a dishwasher.
Figure 2:
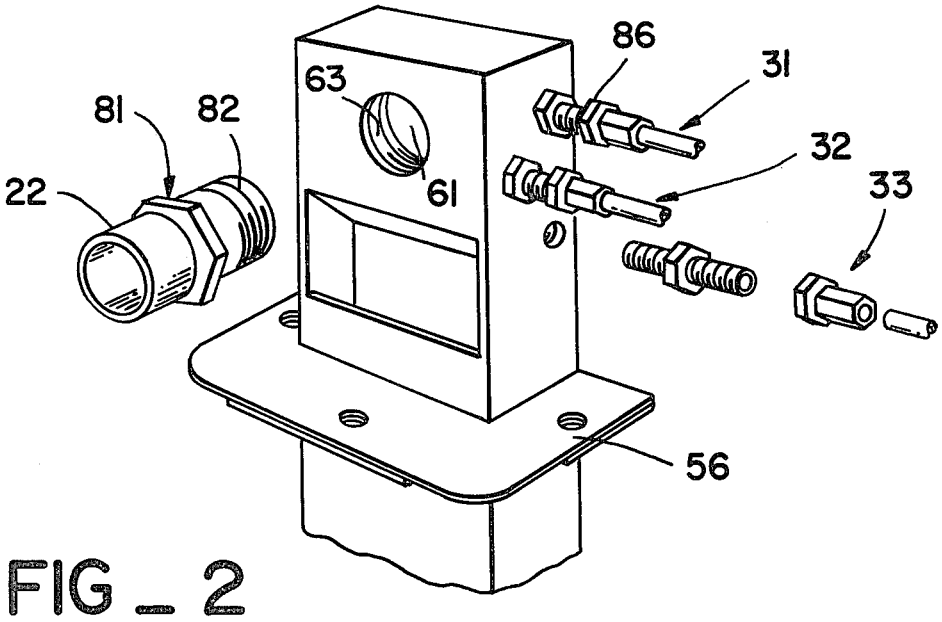
FIG. 2 is an exploded perspective view of the preferred embodiment of the present invention.
Figure 3:
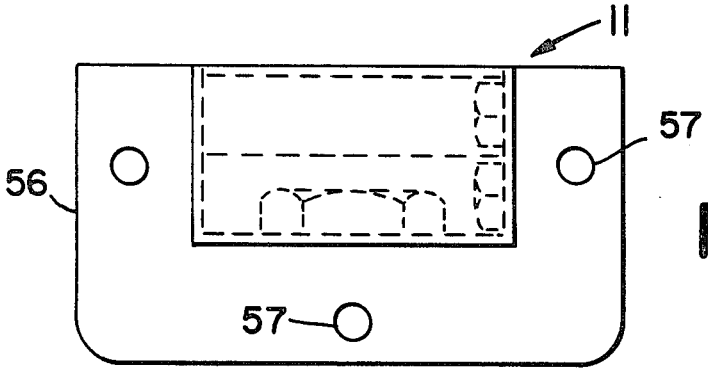
FIG. 3 is a top plan view of the housing of the present invention.
Figure 4:
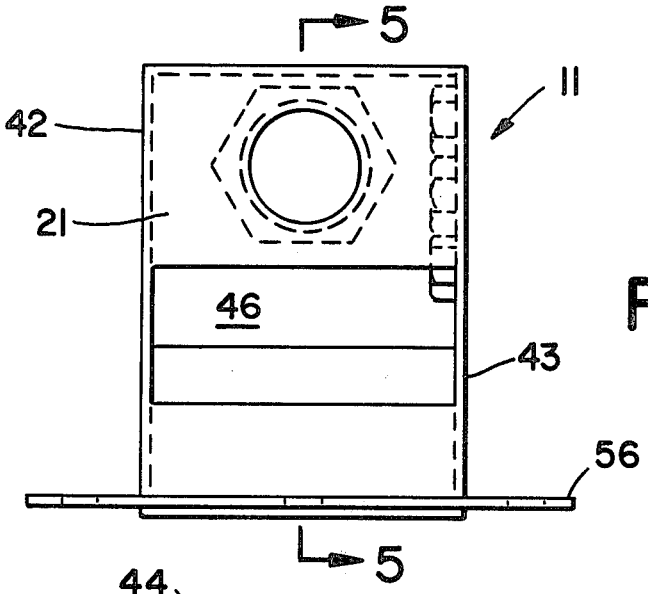
FIG. 4 is a front-elevational view of the chamber housing of FIG. 3.
Figure 5:
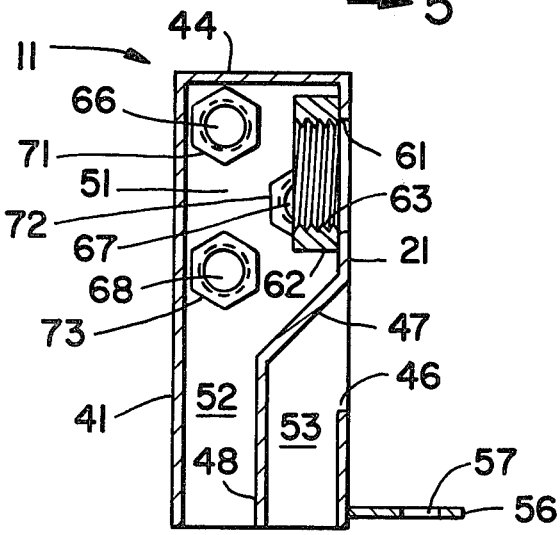
FIG. 5 is a central sectional view taken in the vertical plane 5—5 of FIG. 4.

The present invention, as illustrated in the drawings, includes a chamber housing 11 preferrably provided with a flange 12 about the bottom thereof and adapted to be mounted on a dishwasher 13 over an opening formed in the top thereof. As shown in FIG. 1, there is also provided a depending duct 14 adapted to be mounted within the dishwasher 13 beneath the chamber housing 11 as by bolts 16 extending through the housing flange 12, dishwasher top and lateral tabs about the top of the duct 14.

the housing 11, which is preferrably formed of stainless steel, has a front face 21 through which there is adapted to extend a water inlet pipe 22 for supplying wash and/or rinse water to the dishwasher through the duct 14 as further described below. A water supply assembly 23 is connected between a fresh water pipe 24 and the inlet pipe 22 and may include a pressure relief valve 26, a pressure gauge 27, a shock stop or small surge tank 28 and a solenoid operated control valve 29. Connection of the inlet line 22 to the housing 11 is further described below as is the connection of inlet lines 31, 32 and 33 for chlorine, rinse additive and detergent.

Referring now to FIGS. 2 through 5 it will be seen that the housing 11 is generally comprised as a rectangular box having a front face 21, back wall 41, sides 42 and 43 and top 44. The front face of the housing has an opening 46 extending laterally thereacross immediately below the center of the face and an inclined plate or floor 47 extends inwardly of the housing from the top of this opening 46 to about the center of the housing into engagement with a vertical wall 48 extending laterally across the housing and dividing the interior thereof substantially in half. This structure will thus be seen to define an interior chamber 51 having a floor 47 inclined downwardly and inwardly of the housing to a discharge opening 52 extending downwardly from the chamber between the walls 41 and 48. There is also defined an air gap or passage 53 between the front face 21 of the housing and the vertical wall 48 and inclined wall 47 which thus extends between the opening 46 in the front of the housing and the open bottom of the housing.

A mounting flange 56 extends externally outward of the housing adjacent the bottom thereof across the front and both sides of the housing and this flange plate 56 may be welded to the housing, as illustrated, a short distance above the bottom of the housing for mounting the housing upon a dishwasher 13.

Provision is made in the present invention for connecting inlet lines or pipes to the housing 11 for communication with the mixing chamber 51 therein. To this end there is provided an opening 61 in the upper portion of the front face 21 of the housing with a nut or the like welded to the inside of the front face about this opening to present internal threads 63 in alignment with the opening 61 inside of the housing. There are also provided a plurality of openings 66, 67 and 68 in the side wall 43 of the housing communicating with the mixing chamber 51 therein. Threaded nuts 71, 72 and 73 are attached as by welding to the interior surface of the wall 43 about the openings 66, 67 and 68 respectively. These openings in the side wall 43 are preferrably arranged in staggered arrangement, as indicated, to communicate with the chamber 51 above the discharge 52 therefrom.

The inlet water line 22 is adapted to be connected to the housing 11 at the front opening 61 as by means of a screw fitting 81 having threads 82 about the exterior thereof and a hex head or the like thereon so that the fitting may be screwed into the opening 61 by mating the threads 82 and 63 to thus affix an inlet water line to the housing for discharging water into the mixing chamber 51 therein. Similarly, the chlorine, rinse additive and detergent lines 31, 32 and 33 respectively are provided with screw fittings 86 on the ends thereof for threaded and locking engagement with the bolts 71, 72 and 73 about the side openings 66, 67 and 68 respectively in the housing 11. It will of course be appreciated that suitable control means are provided for passing chemicals through feed lines or chemical lines 31, 32 and 33.

The present invention operates to mix chemicals with water fed to a washing machine, for example, and this is accomplished by directing water through the inlet line 22 in the front face 21 of the housing into the mixing chamber 51. This water then discharges through the bottom discharge 52 of the chamber 51 and then through the duct 14 into the chamber of the dishwasher. As noted above on the duct 14 fed sanitarily of the dishwasher with laterally extending apertured tabs disposed against the underside of the top of of the dishwasher so that mounting bolts 16 may extend through the housing flange 56 and dishwasher top and duct tabs to lock the assembly in position. Preferably the housing extends through the top of the dishwasher to prevent any leakage of water at the connection.

Chemicals are inserted into the mixing chamber through the side openings 66, 67 and 68 via the lines 31, 32 and 33, respectively. Liquid chlorine, for example, controllably discharged into the chamber 51 through the opening 66 while the fresh water is flowing into the chamber 51 through the opening 61 at the front face of the chamber will cause a mixing of chlorine and water which is then discharged through the bottom of the chamber and duct into the dishwasher for use therein during rinsing of dishes or utensils in the normal operation of the dishwasher. It is particularly noted that the duct 14 communicates, not only with the discharge 52 of the mixing chamber 51, but also with the air gap 53 which extends upwardly through the housing to the atmosphere through the opening 46 in the front thereof. It will thus be appreciated that the present invention provides not only a mixing chamber 51 wherein fresh water and chemicals may be controllably mixed, but also provides an opening to the atmosphere through the air gap 53 to preclude the establishment of a vacuum or syphoning situation wherein water could conceivably be drawn back into the fresh water inlet line 22 system. The air gap 53 opens to the atmosphere at the opening 46 vertically below the water inlet opening 61 of the mixing chamber and thus any water that might rise in the housing 11 from a dishwasher would always be discharged through the opening 46 before it could reach the water line 22 connected to the water inlet opening 61 of the mixing chamber. Thus the present invention does provide a vacuum breaker or air gap while at the same time precluding the splashing of water therefrom during fresh water flow and providing an advantageous mixing compartment or chamber for the addition and mixing of chemicals with the fresh water being added to the dishwasher. It will be seen that there is actually a free-fall of inlet water from the present invention so that there is no tendency for fresh water to splash back into the air gap or air passage 53. It is also noted that the bottom of the duct 14 may be closed and inclined to a side opening in the duct for deflecting inlet water as may be desired or required within the dishwasher itself.

Although the present invention has been described above with respect to a single preferred embodiment thereof, it will be apparent to those skilled in the art that various modifications and variations are possible within the spirit of the present invention and thus it is not intended to limit the invention to the precise terms of description or details of illustration.

What is claimed is:

1. A combined mixing chamber and a vacuum breaker comprising a housing having an open bottom with a water inlet in a front face thereof and at least one opening for insertion of a chemical in a wall thereof, an inclined floor in said housing extending inwardly and downwardly from the front face of said housing beneath said openings to a substantially vertical wall dividing said housing laterally thereacross above the open bottom, and said front face of said housing having an aperture therethrough beneath said floor to define an air passage between front and bottom of said housing.

2. The combination of claim 1 further defined by first means defining internal threads about said water inlet for connection of a water pipe thereto, and second means defining internal threads about said opening for insertion of a chemical for connection of a line carrying a chemical.

3. The combination of claim 2 further defined by said housing being formed of stainless steel and said first and second means comprising internally threaded nuts welded to the interior of said housing about said openings.

4. The combination of claim 1 further defined by said housing being rectangular and defining a mixing chamber therein above said inclined floor with a bottom discharge between a back of the housing and said vertical wall with said aperture extending across the front face thereof, and an elongated duct extending downwardly from the open bottom of said housing from said chamber discharge and air passage.

* * * * *